US006281859B1

(12) United States Patent
Winter et al.

(10) Patent No.: US 6,281,859 B1
(45) **Date of Patent: *Aug. 28, 2001**

(54) ANTENNA FOR PERSONAL MOBILE COMMUNICATIONS OR LOCATING EQUIPMENT

(75) Inventors: James Blake Winter; Jon L. Sullivan, both of Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 31 days.

This patent is subject to a terminal disclaimer.

(21) Appl. No.: 09/593,987

(22) Filed: Jun. 14, 2000

Related U.S. Application Data

(63) Continuation of application No. 09/160,481, filed on Sep. 25, 1998.

(51) Int. Cl.[7] ..... H01Q 1/36
(52) U.S. Cl. ..... 343/895; 343/860
(58) Field of Search ..... 343/895, 702, 343/820, 850, 860, 861, 856, 864; H01Q 1/36

(56) References Cited

U.S. PATENT DOCUMENTS

| | | | |
|---|---|---|---|
| 4,799,066 | 1/1989 | Deacon | 343/861 |
| 5,255,005 | 10/1993 | Terret et al. | 343/895 |
| 5,346,300 | 9/1994 | Yamamoto et al. | 343/895 |
| 5,349,365 | 9/1994 | Ow et al. | 343/895 |
| 5,541,617 | 7/1996 | Connolly et al. | 343/895 |
| 5,635,945 | 6/1997 | McConnell et al. | 343/895 |
| 6,150,994 * | 11/2000 | Winter et al. | 343/895 |

* cited by examiner

*Primary Examiner*—Tho Phan
(74) *Attorney, Agent, or Firm*—Zarley, McKee, Thomte, Voorhees & Sease; Dennis L. Thomte

(57) ABSTRACT

A quadrifilar helix antenna of the present invention is used with a wireless device to transmit and receive signals. The antenna includes a plurality of helical antenna elements and an impedance transformer electrically connected to the antenna elements and connectable to the wireless device. The impedance transformer may be comprised of either a planar transmission line ¼ wave impedance transformer or a pi-network impedance transformer. The antenna may also be comprised of dual band quadrifilar helix antenna for transmitting or receiving two different frequency bands.

2 Claims, 2 Drawing Sheets

ANTENNA FOR PERSONAL MOBILE COMMUNICATIONS OR LOCATING EQUIPMENT

CROSS-REFERENCE TO RELATED APPLICATION

This is a continuation application of Petitioners' earlier application Ser. No. 09/160,481 filed Sep. 25, 1998, entitled ANTENNA FOR PERSONAL MOBILE COMMUNICATIONS OR LOCATING EQUIPMENT.

BACKGROUND OF THE INVENTION

1. Field of the Invention

The present invention relates to wireless radio equipment. More particularly, though not exclusively, the present invention relates to a method and apparatus for providing improved quadrifilar helix antennas.

2. Problems in the Art

Some antennas, such as satellite antennas, require circular polarization because the orientation of the user with respect to the satellite is not usually predetermined. Circular polarization is typically independent of orientation. Few antennas are suitable for circular polarization, especially for use with handheld wireless equipment. Three types of prior art circularly polarized antennas include turnstile antennas, patch antennas, and axial mode helical antennas. The turnstile and patch antennas are riot suitable for use with handheld equipment because the antennas are larger than desired. Axial mode helical antennas are not suitable for use with handheld equipment because of the excessive diameter of the antenna.

The most desirable type of circularly polarized antenna is a quadrifilar helix antenna. To meet beam width and size requirements for personal satellite communications, quadrifilars are made with ½ turn, ¼ wave elements. Hybrid power dividers are required to establish the phase between elements of the quadrifilar helix antenna. However, hybrid power dividers require more space than is desirable. Therefore, there is need for a quadrifilar helix antenna which does not require hybrid power dividers.

FEATURES OF THE INVENTION

A general feature of the present invention is the provision of a method and apparatus for providing an improved quadrifilar helix antenna which overcomes problems found in the prior art.

A further feature of the present invention is the provision of a method and apparatus for providing an improved quadrifilar helix antenna requiring no hybrid power dividers.

Further features, objects, and advantages of the present invention include:

A method and apparatus for providing an improved quadrifilar helix antenna which includes a planar transmission line ¼ wave impedance transformer as a matching circuit.

A method and apparatus for providing an improved quadrifilar helix antenna which includes a pi-network impedance transformer as a matching circuit.

A method and apparatus for providing an improved antenna having dual quadrifilar helix antennas and a band-pass filter for isolation.

A method and apparatus for providing an improved antenna having dual quadrifilar helix antennas and pi-network impedance transformers for isolation.

A method and apparatus for providing an improved quadrifilar helix antenna including parallel resonant circuits in series with each helical element.

These as well as other features, objects and advantages of the present invention will become apparent from the following specification and claims.

SUMMARY OF THE INVENTION

A quadrifilar helix antenna for a wireless device is used with a wireless device to transmit or receive signals. The invention is comprised of a plurality of helical antenna elements and an impedance transformer electrically connected to the antenna elements and connectable to the wireless device. The impedance transformer may optionally be comprising of a planar transmission line ¼ wave impedance transformer or a pi-network impedance transformer. The antenna may also be comprised of dual band quadrifilar helix antenna for transmitting or receiving two different frequency bands.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

The present invention relates to a technique for feeding a quadrifilar helix antenna which reduces the size of the antenna components by eliminating the need for hybrid circuits.

Figure 1:
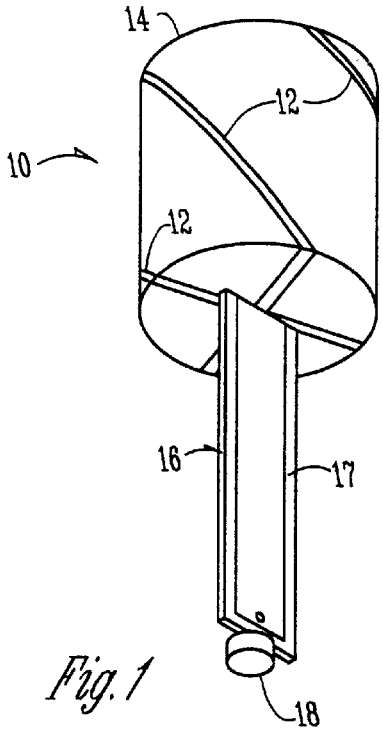
FIG. 1 illustrates a quadrifilar helix antenna of the present invention having ¼ wave helical elements and a ¼ wave transformer.

FIG. 1 shows a left-hand circularly polarized (per IEEE standard) ½ turn, ¼ wave quadrifilar helix antenna 10. The quadrifilar helix antenna 10 includes four helical elements 12. A quadrifilar having ½ turn, ¼ wave elements is the smallest practical length achievable. As the diameter of a quadrifilar helix antenna decreases, the input resistance decreases, necessitating the inclusion of a quarter-wave transformer (described below). The helical elements 12 are approximately ¼ wavelength long and are wound around a coil form 14 made of low loss dielectric material. The leading helical elements are shorter than the lagging helical elements to provide a 90° phase shift between leading and lagging. The leading helical elements are shorter than the lagging helical elements by only approximately 0.015 inches. The 90° phase shift between each set of bifilars provides a cardioid pattern from the two sets of bifilar helix antenna elements 12 which comprise the quadrifilar. By switching which elements lead or lag, the direction (up or down) of the cardioid can be controlled. Examples of helical elements suitable as the elements 12, are described in detail in U.S. Pat. No. 5,541,617 and in the publication "Reflections: Transmission Lines and Antennas", published by American Radio Relay League, 1990, Chapter 22, which are incorporated by reference herein.

The helical elements 12 are connected to a flexible planar transmission line ¼ wave transformer 16 formed on a flexible circuit board 17. The transformer 16 is comprised of a conventional ¼ wave transmission line. Preferably, the connection between the elements 12 and the transformer 16 is made by a solder joint. The connection between the transformer 16 and the helical elements 12 is relatively short compared to the wavelength and disturbs the antenna pattern minimally. The direct connection of the helical elements 12 of the antenna 10 to the transformer 16, and the shortness of the connection allows the elimination of the hybrid power divider. As the diameter of the antenna decreases, the distortion of the fields caused by the horizontal feed elements from the transformer to the filars decreases, allowing the elimination of the hybrid power divider.

The opposite end of the transformer 16 is connected to an RF connector 18. The RF connector 18, in turn, is connected to a transmitter/receiver (not shown). The RF connector 18 has the same intrinsic impedance as the remainder of the transmitter/receiver. The entire antenna 10 shown in FIG. 1 is preferably enclosed in a protective housing (not shown).

Figure 2:
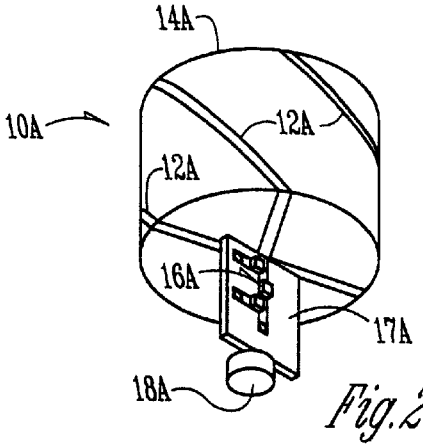
FIG. 2 illustrates a quadrifilar helix antenna of the present invention having ¼ wave helical elements and a pi-network impedance transformer.

Further size reduction of the antenna 10 can be achieved by replacing the quarter-wave transformer 16 with a discrete component pi-network. FIG. 2 shows an antenna 10A which is similar to the antenna 10 shown in FIG. 1 except that the planar transmission line ¼ wave transformer 16 is replaced with a pi-network impedance transformer 16A formed on a small circuit board 17A. As shown, the ½ turn, ¼ wave quadrifilar helix antenna 10A includes four helical elements 12A wound around the coil form 14A.

The helical elements 12A are connected to the pi-network impedance transformer 16A by a solder joint, similar to the joint on antenna 10. The impedance transformer 16A is comprised of a conventional pi-network impedance transformer. The opposite end of the transformer 16A is connected to an RF connector 18A. The IRF connector 18A, in turn, is connected to a transmitter/receiver (not shown).

In some applications, dual band quadrifilar helix antennas are needed for separate transmit and receive bands on personal mobile satellite communications equipment. In one example, the transmit band is at a lower frequency and the receive band is at a higher frequency, or visa versa. The embodiments shown in FIGS. 3–7 Illustrate examples of dual band quadrifilar helix antennas of the present invention.

Figure 3:
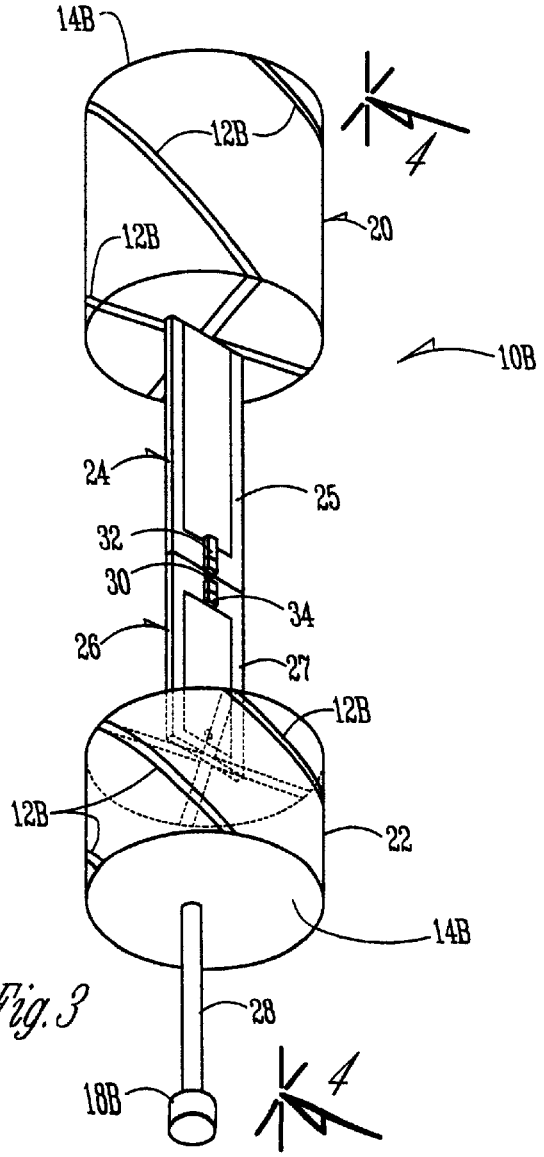
FIG. 3 illustrates a quadrifilar helix antenna of the present invention having ¼ wave helical elements on two quadrifilars, two band pass filters, and two ¼ wave transformers.
Figure 4:
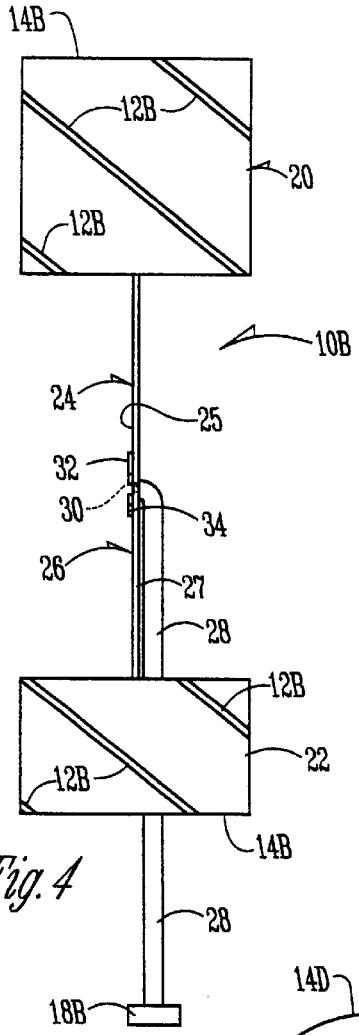
FIG. 4 is a side view of the antenna shown in FIG. 3.

FIGS. 3 and 4 show an antenna 10B which is similar to the antenna 10 shown in FIG. 1 except that antenna 10B includes an upper quadrifilar 20 and a lower quadrifilar 22. The quadrifilars 20 and 22 each are formed by helical elements 123 wound around coil forms 14C. The helical elements 12B of the upper quadrifilar 20 are connected to an upper flexible planar transmission line ¼ wave transformer 24 formed on a flexible circuit board 25. The helical elements 12B of the lower quadrifilar 22 are connected to a lower flexible planar transmission line ¼ wave transformer 26 formed on a flexible circuit board 27. The transformers 24 and 26, like the transformers 16 and 16A, are comprised of conventional ¼ wave transmission lines. Preferably, the connections between the elements 12B and the transformers 24 and 26 are made by solder joints. The transformers 24 and 26 are connected together at a junction 30. Two band pass filters 32 and 34 connected between the junction 30 and the transformers 24 and 26 are used to isolate the transformers 24 and 26 from one another. Without the band pass filters 32 and 34, transformers 24 and 26 would detune each another. The band separation between the quadrifilars 20 and 22 insures that mutual coupling is minimized.

The space on top of some devices, such as a phone, is limited, forcing the quadrifilars 20 and 22 to be coaxially located with respect to each other. The lower quadrifilar 22 has a coaxial transmission line 28 centered in the helical elements 12B which connects to the junction 30 formed between the planar transmissions lines 24 and 26. The symmetry of the antenna 103 is disturbed if the coaxial transmission line 28 is not centered along the axis of the quadrifilar 22. FIG. 4 is a side view of the antenna 10B showing the coaxial transmission line 28. As shown, the coaxial transmission line 28 extends through the coil form 14B, along side the transformer 26, where it is soldered to the junction 30.

Figure 5:
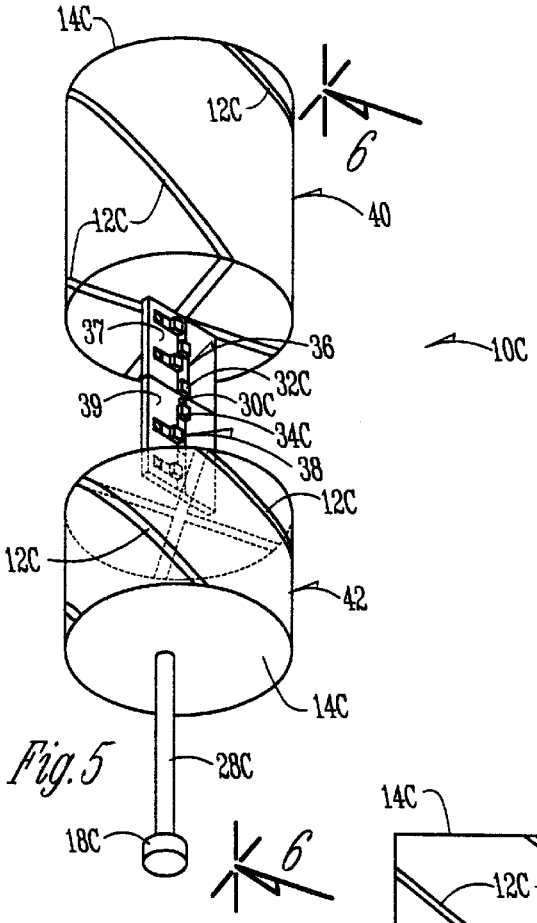
FIG. 5 illustrates a quadrifilar helix antenna of the present invention having ¼ wave helical elements on two quadrifilars with two pi-network impedance transformers.
Figure 6:
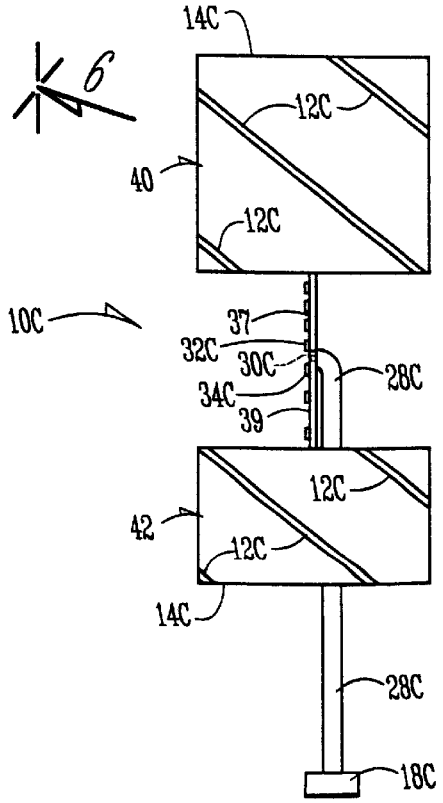
FIG. 6 is a side view of the antenna shown in FIG. 5.

FIGS. 5 and 6 show an antenna 10C which is similar to the antenna 10B shown in FIGS. 3 and 4 except that the ¼ wave transformers 24 and 26 are replaced by pi-network impedance transformers 36 and 38 formed on small circuit boards 37 and 39. The quadrifilars 40 and 42 each are formed by helical elements 12C wound around coil forms 14C. The helical elements 12C of the upper quadrifilar 40 are connected to the upper pi-network impedance transformer 36 formed on the circuit board 37. The helical elements 12C of the lower quadrifilar 42 are connected to the lower pi-network impedance transformer 38 formed on the circuit board 39. The transformers 36 and 38 are comprised of conventional pi-network impedance transformers. Preferably, the connections between the elements 12C and the transformers 36 and 38 are made by solder joints. The transformers 36 and 38 are connected together at a junction 30C. Two band pass filters 32C and 34C connected between the junction 30C and the transformers 36 and 38 are used to isolate the transformers 36 and 38 from one another, as described above with respect to FIGS. 3 and 4.

The lower quadrifilar 42 has a coaxial transmission line 28C centered in the helical elements 12C which connects to the junction 30C formed between the transformers 36 and 38. FIG. 6 is a side view of the antenna IOC showing the coaxial transmission line 28C. As shown, the coaxial transmission line 28C extends through the coilform 14C, along side the transformer 38, where it is soldered to the junction 30C.

Figure 7:
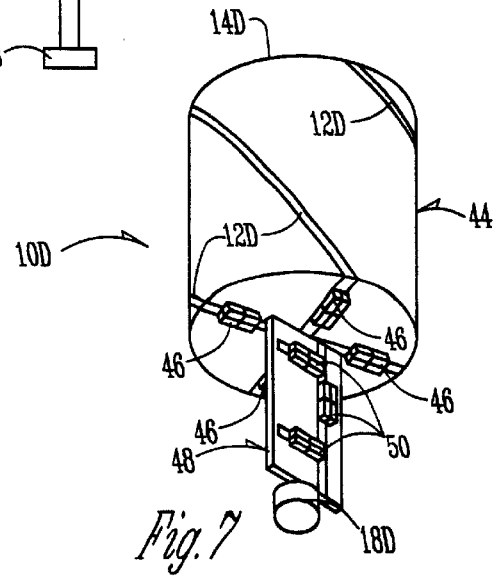
FIG. 7 illustrates a dual band quadrifilar helix antenna of the present invention having a single quadrifilar for two frequency bands.

FIG. 7 illustrates a technique which allows the use of a single quadrifilar for dual frequency bands, further reducing the size of the antenna. Two series resonant circuits in parallel with one another but in series with each of the quadrifilar elements provides for electrical lengthening of the elements in the upper band and electrical shortening of the elements in the lower band.

FIG. 7 shows an antenna 10D which is similar to the antennas described above. The antenna 10D includes a quadrifilar 44 having four helical elements 12D wound around a coilform 14D and series-parallel resonant circuit 46 associated with each helical element 12D. The series-parallel resonant circuits are comprised of conventional resonant circuits which would normally be used as bandpass filters, but also include a reactance to electrically lengthen or shorten the quadrifilar elements.

As shown, the antenna elements 12D are connected to a dual band impedance transformer 48. The impedance transformer 48 is comprised of conventional reactive elements 50 that serve to transform different impedances at each of the two frequency bands.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

Thus it can be seen that the invention accomplishes at least all of its stated objectives.

We claim:

1. A dual band quadrifilar helix antenna for a wireless communication device, comprising:

a single quadrifilar having a plurality of helical antenna elements for receiving or transmitting signals in a first and second frequency band; and a dual band impedance transformer electrically connected to the plurality of antenna elements of the quadrifilar, wherein the dual band impedance transformer is transforms different impedances for the first and second frequency bands.

2. The dual band quadrifilar helix antenna of claim 1 further comprising series parallel resonant circuits associated with each of the helical antenna elements for electrical lengthening of the helical elements in the first frequency band and electrical shortening of the helical elements in the second frequency band.

* * * * *